US006203454B1

(12) United States Patent
Nashif et al.

(10) Patent No.: US 6,203,454 B1
(45) **Date of Patent: *Mar. 20, 2001**

(54) MULTI-MODE VIBRATION ABSORBING DEVICE FOR IMPLEMENTS

(75) Inventors: Ahid D. Nashif, Cincinnati, OH (US); Gopichand Koganti, Sunnyvale, CA (US)

(73) Assignee: Roush Anatrol, Inc., Sunnyvale, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/078,170

(22) Filed: May 13, 1998

Related U.S. Application Data

(63) Continuation of application No. 08/580,297, filed on Dec. 28, 1995, now Pat. No. 5,935,027.

(51) Int. Cl.[7] ..... A63B 49/08
(52) U.S. Cl. ..... 473/521; 473/549
(58) Field of Search ..... 473/549, 524, 473/521, 520, 523, 297, 560, 564; 81/20, 22, 489

(56) References Cited

U.S. PATENT DOCUMENTS

| | | | | |
|---|---|---|---|---|
| 4,690,405 | | 9/1987 | Frolow . | |
| 4,811,947 | * | 3/1989 | Takatsuka et al. | 473/523 |
| 4,826,167 | | 5/1989 | Lo . | |
| 4,875,679 | | 10/1989 | Movilliat et al. . | |
| 4,951,948 | | 8/1990 | Peng . | |
| 5,039,096 | | 8/1991 | Chen . | |
| 5,092,594 | | 3/1992 | Jang . | |
| 5,104,123 | | 4/1992 | Okitsu et al. . | |
| 5,180,163 | | 1/1993 | Lanctot et al. . | |
| 5,219,164 | | 6/1993 | Peng . | |
| 5,236,198 | | 8/1993 | Haines et al. . | |
| 5,269,516 | | 12/1993 | Janes . | |
| 5,289,742 | * | 3/1994 | Vaughan, Jr. | 81/22 |
| 5,303,917 | | 4/1994 | Uke . | |
| 5,374,057 | | 12/1994 | Lai et al. . | |
| 5,380,003 | | 1/1995 | Lanctot . | |
| 5,409,218 | | 4/1995 | You . | |
| 5,454,562 | | 10/1995 | Sommer . | |
| 5,511,777 | | 4/1996 | McNeely . | |
| 5,935,027 | * | 8/1999 | Nashif et al. | 473/521 |

* cited by examiner

*Primary Examiner*—Raleigh W. Chiu
(74) *Attorney, Agent, or Firm*—Bliss McGlynn, P.C.

(57) ABSTRACT

A multi-mode vibration absorbing device for implements includes a base member and a mass mounted to the base member and cantilevered relative thereto. The multi-mode vibration absorbing device is tuned such that it vibrates at the same frequency as the implement but out of phase therewith.

13 Claims, 4 Drawing Sheets

MULTI-MODE VIBRATION ABSORBING DEVICE FOR IMPLEMENTS

Continuation of prior application Ser. No.: 08/580,297, filed on Dec. 28, 1995, now U.S. Pat. No. 5,935,027.

BACKGROUND OF THE INVENTION

1. Field of the Invention

The present invention relates generally to vibration absorbing devices and, more particularly, to a multi-mode vibration absorbing device for implements.

2. Description of the Related Art

The popularity of sports involving implements, such as golf, tennis, hockey and racquet ball, continues at a strong pace. Better engineering, better materials, lighter, stronger implements have improved the play of games with these implements and thereby increased the enjoyment associated therewith. Although these implements have worked well, they suffer from the disadvantage that, despite improvements in other areas, the unwanted vibratory phenomena generated upon an impact with an object which is not dead center in the "sweet spot" of the implement remains.

Lighter implements have allowed players to swing harder at the object. Larger implements, while increasing the "sweet spot" thereof, have also increased the area outside the "sweet spot", providing increased opportunity for imperfect or offset contact with the object.

For example, when an object impacts the implement, the implement excites in a fashion defined by the amount of force, location of impact and the dynamics of the implement structure. The magnitude and location of the impact 6 on the implement 8, as illustrated in FIGS. 1A, 1B and 1C, will cause either one or several modes to excite. Each of these modes will vibrate at a different frequency. The modes excited are the bending mode as illustrated in FIG. 1A, the torsional mode as illustrated in FIG. 1B and the longitudinal mode as illustrated in FIG. 1C. The longitudinal mode may be excited, for example, when the object such as a ball contacts the implement such as a tennis racquet during a serve.

Any excitation is usually expressed as a linear combination of the dynamic modes of the implement as follows:

$$\mu = \sum_{i=1}^{\infty} a_i x_i$$
$$= a_1 x_1 + a_2 x_2 + a_3 x_3 \ldots$$

where $\mu$ is the excitation, $x_1$, $x_2$, $x_3$ . . . etc. are the mode shapes and $a_1$, $a_2$, $a_3$, etc. are the coefficients which dictate the contribution of each mode towards the total excitation. In most cases, the energy from the impact excites the first frequency and the spin off energy will excite the second frequency and so on. The most probable modes that are subject to excitation are the first bending mode and first torsional mode. Nevertheless, the other modes get excited when there is enough energy generated during the impact.

Additionally, certain implements such as tennis racquets have increased in length, thereby lowering the natural frequencies of the racquets. For example, the second bending mode of the tennis racquet may have been lowered from five hundred hertz to three hundred hertz for a particular racquet. Thus, there is a need in the art to provide a vibration absorbing device for implements which will effectively damp out the vibrations caused by various modes at various frequencies due to impact.

SUMMARY OF THE INVENTION

It is, therefore, one object of the present invention to provide a multi-mode vibration absorbing device for an implement.

It is another object of the present invention to provide a multi-mode vibration absorbing device for an implement which effectively cancels vibration generated by unbalance forces due to an off center contact with an object.

It is yet another object of the present invention to provide a multi-mode vibration absorbing device which absorbs energy at multiple frequencies of an implement due to impact.

To achieve the foregoing objects, the present invention is a multi-mode vibration absorbing device for an implement including a base member at least partially disposed within the implement and a mass mounted to the base member and cantilevered relative to the base member. The device is tuned such that upon impact of the implement the mass generates energy and deforms the base member. The base member acts to absorb the energy generated by the mass and to release the absorbed energy to the implement to counteract energy produced in the implement due to impact.

One advantage of the present invention is that a multi-mode vibration absorbing device is provided for an implement in which the device itself is a vibrating system. Another advantage of the present invention is that the multi-mode vibration absorbing device vibrates at the same set of frequencies or multiple frequencies as the implement. Yet another advantage of the present invention is that the implement and multi-mode vibration absorbing device vibrate at the same set of frequencies and in a phase opposite to each other to cancel out each other and the resultant responses in the implement are reduced by a significant amount. Still another advantage of the present invention is that the multi-mode vibration absorbing device absorbs energy at multiple frequencies of the implement due to impact. A further advantage of the present invention is that the multi-mode vibration absorbing device reduces vibrations in the implement due to impact and the human arms tends to absorb much less energy.

Other objects, features and advantages of the present invention will be readily appreciated as the same becomes better understood after reading the subsequent description taken in conjunction with the accompanying drawings.

DESCRIPTION OF THE PREFERRED EMBODIMENT(S)

Figure 1A:
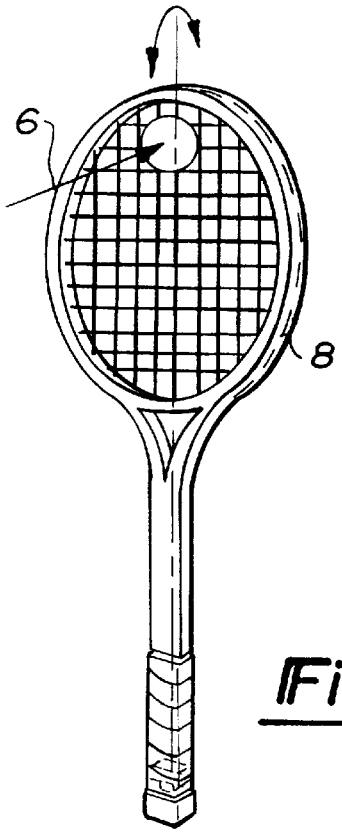
FIGS. 1A, 1B and 1C are perspective views of an implement illustrating bending, torsional and longitudinal modes of vibration respectfully.
Figure 1B:
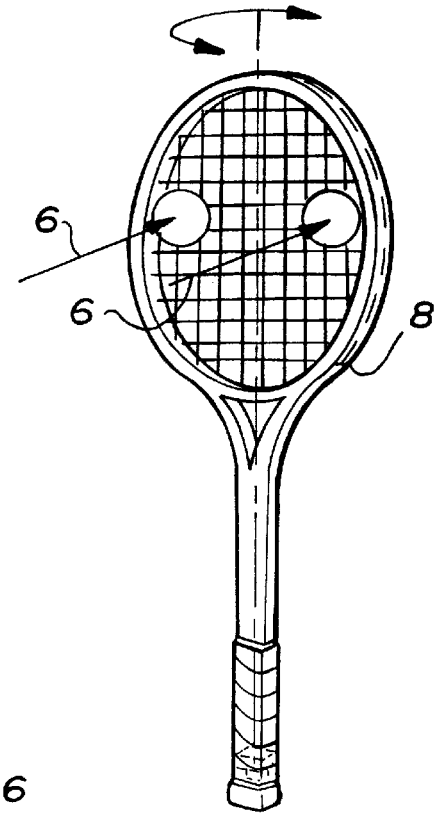
Figure 1C:
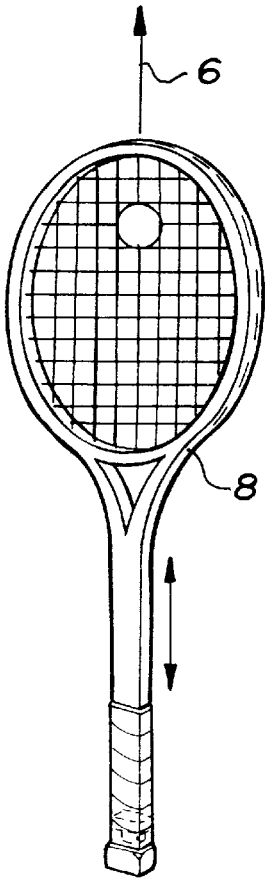
Figure 2:
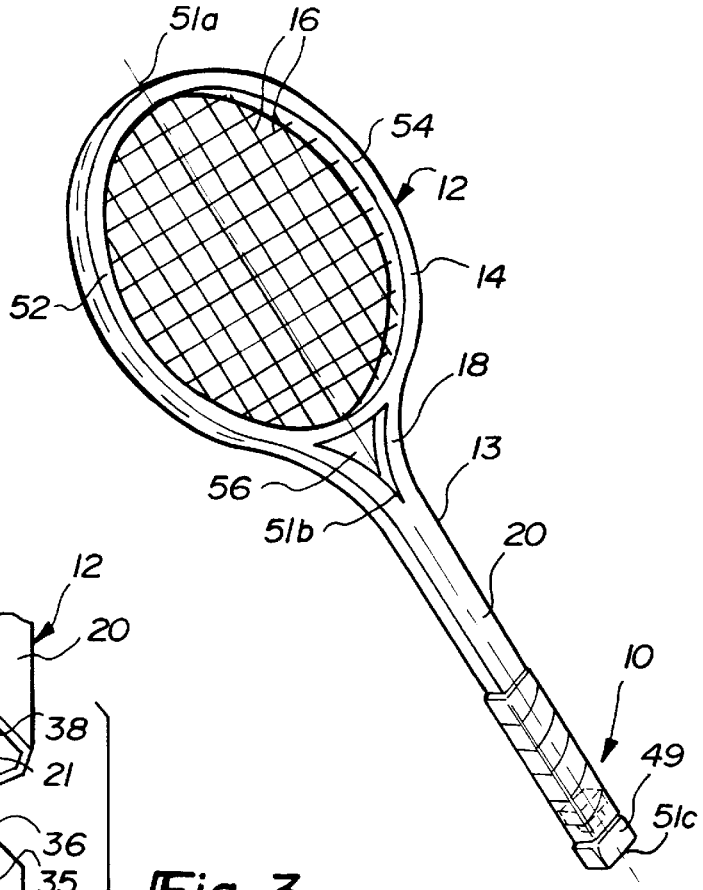
FIG. 2 is a perspective view of a multi-mode vibration absorbing device, according to the present invention, illustrated in operational relationship with an implement.

Referring to the drawings and in particular to FIG. 2, one embodiment of a multi-mode vibration absorbing device 10, according to the present invention, is shown for an implement, generally indicated at 12, such as a tennis racquet. The multi-mode vibration absorbing device 10 is employed to reduce multiple frequency vibrations in the implement 12. It should be appreciated that the implement 12 may be any suitable type of sporting implement such as a golf club, hockey stick or stringed racquet or hand operated implement such as a hammer or ax.

Figure 3:
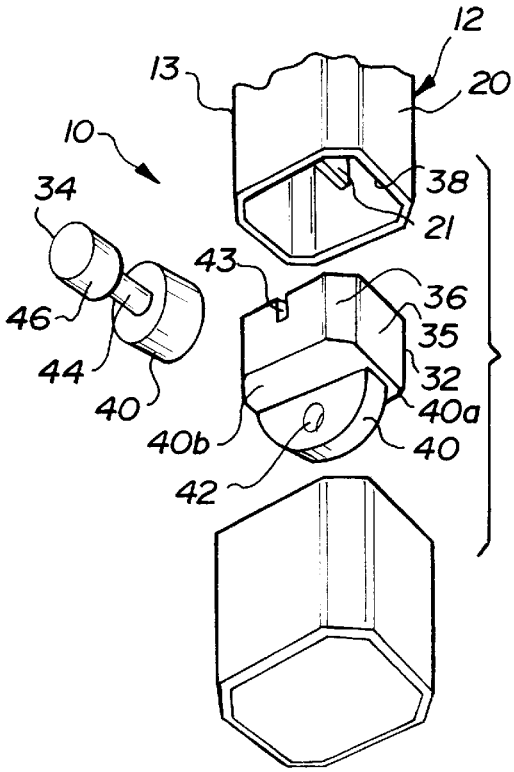
FIG. 3 is an exploded view of the multi-mode vibration absorbing device and implement of FIG. 2.
Figure 4:
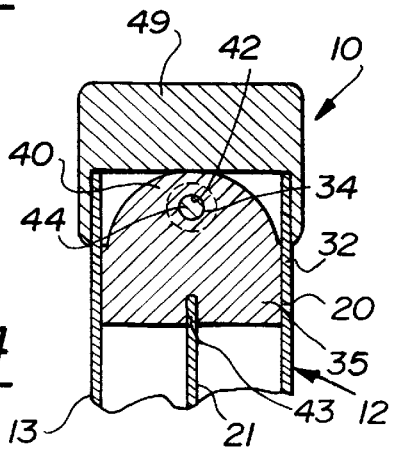
FIG. 4 is a fragmentary view of the multi-mode vibration absorbing device of FIG. 2.

The implement 12, in this example, generally includes a frame 13 having a head 14, strings 16, a throat 18 and a handle 20 as is known in the art. As illustrated in FIGS. 3 and 4, the racquet frame 13 has a reinforcement member 21 that divides the interior of the racquet frame 13 into two chambers. It should be appreciated that the racquet frame 13 is conventional and known in the art.

Referring to FIGS. 2 through 4, the multi-mode vibration absorbing device 10 is disposed in one end of the handle 20 to reduce multiple frequency vibrations in the implement 12. The vibration absorbing device 10 includes a base member 32 and a mass 34 mounted to the base member 32. The base member 32 has a body 35 which is generally rectangular in shape and has an outer surface 36 conforming to an interior surface 38 of the handle 20 to fit snugly therein. The base member 32 includes a projection 40 extending outwardly axially to divide the base member 32 into a first side 40*a* and a second side 40*b*. The projection 40 has a width less than a width of the body 35. The projection 40 also has an aperture 42 extending therethrough. The body 35 has a slot 43 at one end to receive the reinforcement member 21. The base member 32 is made of a visco-elastic material such as rubber. It should be appreciated that the multi-mode vibration absorbing device 10 may be tuned by placing the projection 40 at a non-central location of the base member 32 or by an unequal stiffness in first side 40*a* and second side 40*b* of the base member 32.

The mass 34 is generally cylindrical in shape defining a longitudinal axis or shaft 44 and has a first head 46 at one end of the shaft 44 and a second head 48 at the other end of the shaft 44. Preferably, the first head 46 and second head 48 are generally circular in cross-section. The mass 34 is made of a metal material such as brass. The properties of the base member 32 and the mass 34 are chosen such that the frequencies of the vibration absorbing device 10 are comparable to the same set of frequencies of the implement 12. The bending, torsional and longitudinal frequencies can be tuned by varying the length, width and thickness and material of the projection 40. The torsional frequency can be tuned, for example, by unequal distribution of the mass 34 such that the second head 48 has a diameter greater than the first head 46 or by placing the mass 34 at a non-central location relative to the base member 32.

The mass 34 extends through the aperture 42 such that the projection 40 is disposed between the heads 46 and 48 and is cantilevered relative to the base member 32. A cap 49 is placed over the end of the handle 20 to enclose the vibration absorbing device 10. The cap 49 is made of a plastic material. The mass 34 and base member 32 and their geometries are tuned such that the vibration absorbing device 10 vibrates at the same set of frequencies as the implement 12 but out of phase therewith. The mass 34 vibrates one hundred eighty degrees (180°) out of phase with the implement 12. The base member 32 acts to absorb the energy at multiple frequencies generated by the mass 34 and to release the absorbed energy to the implement 12 to counteract energy produced in the implement 12 due to impact.

The following dynamical description of the implement 12 and multi-mode vibration absorbing device 10 will include terms such as nodes and anti-nodes. It should be appreciated that the nodes/anti-nodes are defined when the implement 12 is not being held by a user.

Assuming the impact location is offset by a large distance and the impact force is large, the bending mode vibrates in a pattern of, for example, two nodes and three anti-nodes. The anti-nodes are typically located at three places: an anti-node 51*a* located at the top of the implement 12; an anti-node 51*b* located at the intersection of the handle 20 and the head 14; and an anti-node 51*c* located at the end of the handle 20. The nodes are located in between the anti-nodes. The vibration damping device 10 has less effect when installed at the nodes and should be placed at the anti-nodes, preferably the anti-node 51*c*. In cases where this is not possible, the vibration damping device 10 should be placed as far away from the nodes as possible.

Figure 5:
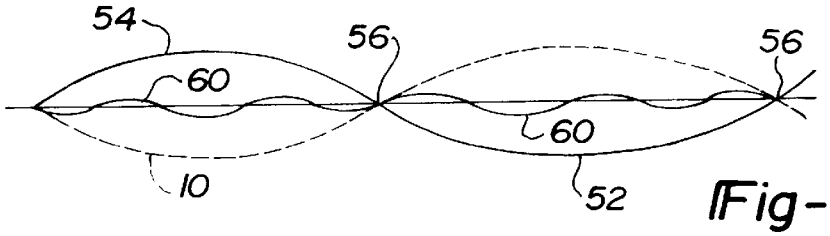
FIG. 5 is a schematic diagram illustrating vibratory motion of the multi-mode vibration absorbing device and implement of FIG. 2.

Assuming the impact location is offset by a large distance and also the impact force is large, the excitations cause the implement 12 to vibrate at more than one frequency at bending and torsional modes. Although the amount of vibration due to each mode cannot be identified accurately, the vibration effects are felt by the user. The pattern of vibration for the torsional mode is a set of two anti-nodes 52 and 54 at each extreme side of the head 14 and a node line 56 at the center. The multi-mode vibration absorbing device 10 is located at the node line 56. When the implement 12 is held with a hand of the user, the node line 56 shifts laterally and is, therefore, located to properly damp vibrations of the implement 12. When properly damped using the multi-mode vibration absorbing device 10 of the present invention, the resultant vibration in the implement 12 is dramatically reduced as indicated at 60 in FIG. 5.

Figure 6:
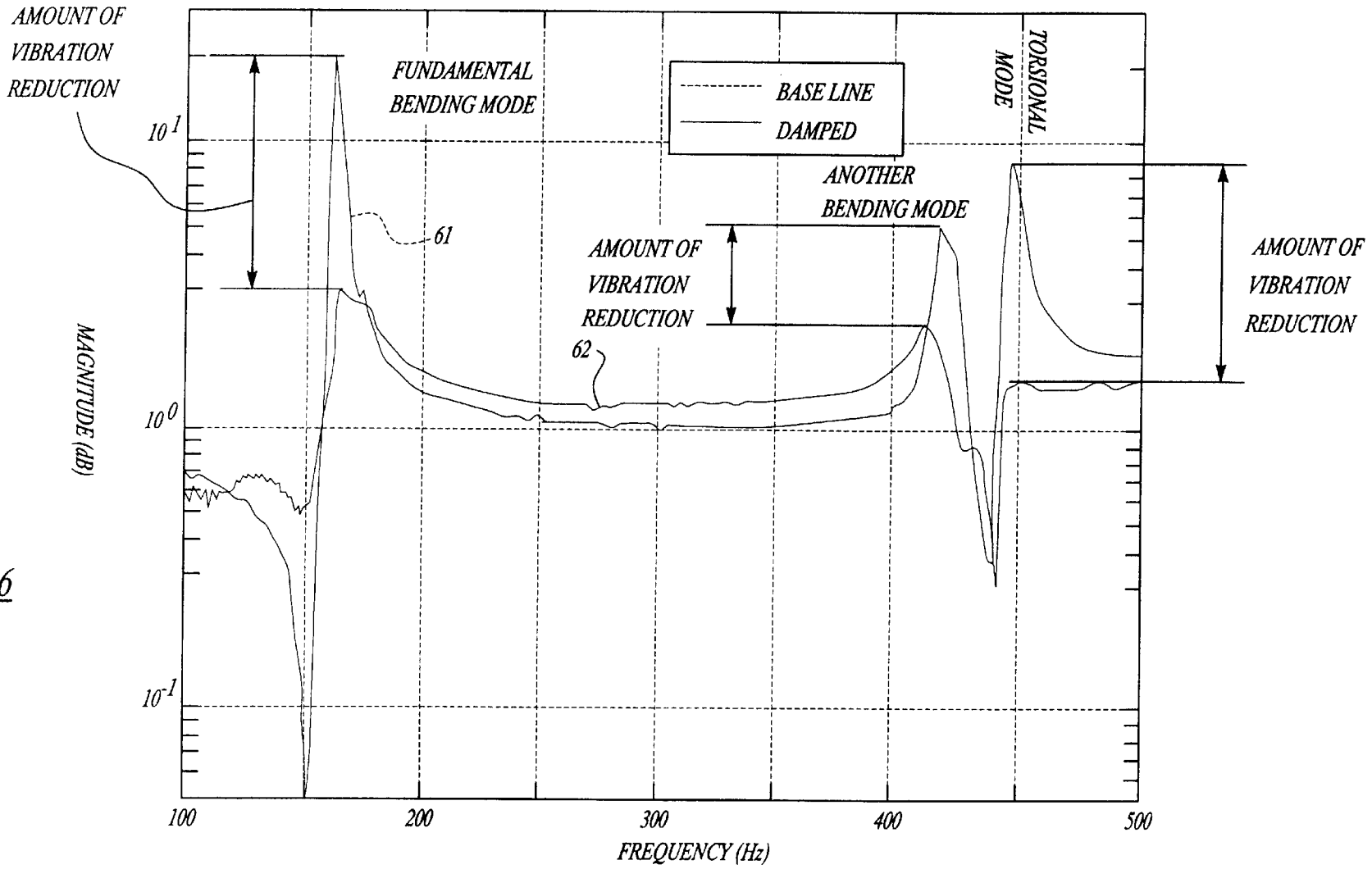
FIG. 6 is a graph comparing relative frequency responses at handle between an undamped implement and a damped implement employing the multi-mode vibration absorbing device according to the present invention.

Referring to FIG. 6, a graph of magnitude (dB) versus frequency (Hz) at the handle 20 is shown for an, implement 12 without the multi-mode vibration absorbing device 10 (baseline) and with the multi-mode vibration absorbing device 10 (damped). A baseline curve 61 and damped curve 62 are illustrated. The peaks of the curves 61 and 62 represent the various modes. The peak of the baseline curve 61 for the implement 12 without the multi-mode vibration absorbing device 10 is significantly greater in magnitude than the peak for the damped curve 62 for the implement 12 with the multi-mode vibration absorbing device 10.

Figure 7:
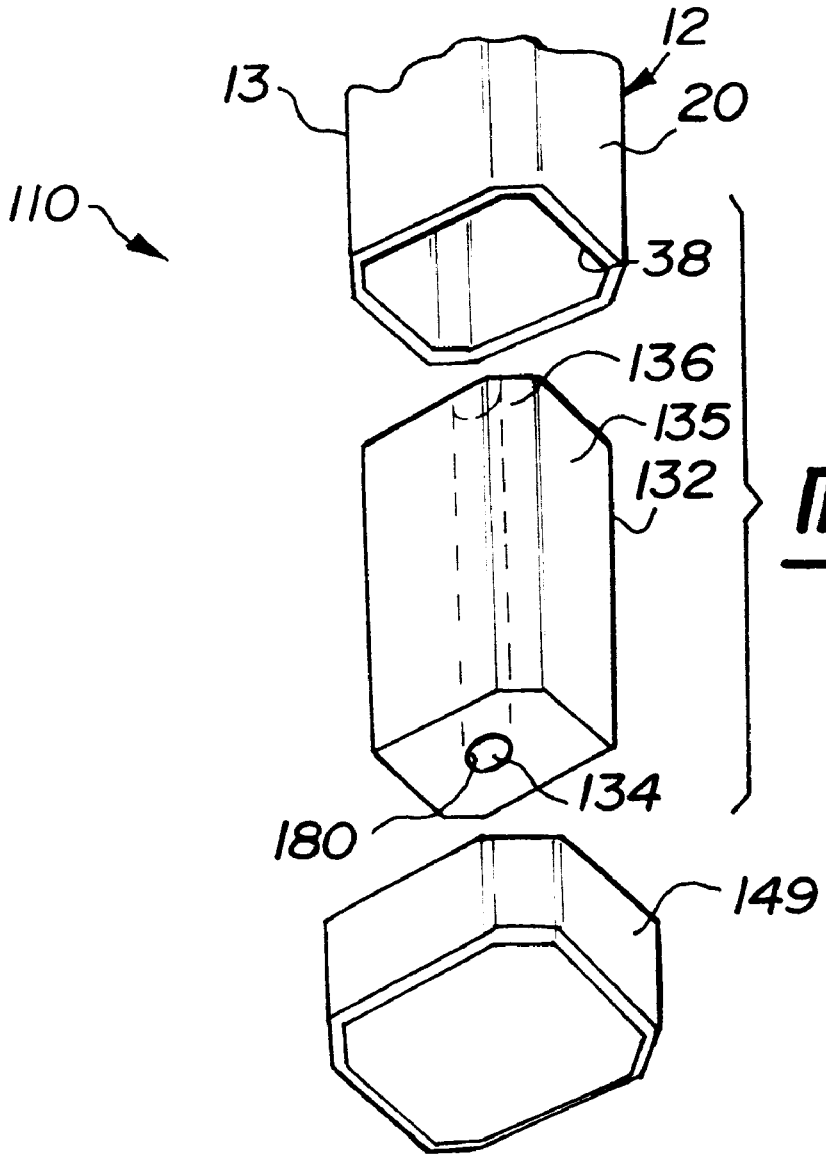
FIG. 7 is an exploded view of another embodiment of the multi-mode vibration absorbing device and implement of FIG. 2.

Referring to FIG. 7, another embodiment 110 of the multi-mode vibration absorbing device 10 is shown. Like parts of the vibration absorbing device 10 have like reference numerals increased by one hundred (100) The vibration absorbing device 110 is disposed in one end of the handle 20 to reduce multiple frequency vibrations in the implement 12. The vibration absorbing device 110 includes a base member 132 and a mass 134 mounted to the base member 132. The base member 132 has a body 135 which is generally cylindrical in shape and has an outer surface 136 conforming to an interior surface 38 of the handle 20 to fit snugly therein. The body 135 has an aperture 180 extending therethrough. The base member 132 is made of a high damping visco-elastic material such as rubber, foam or polyester.

The mass 134 is generally cylindrical in shape and has a longitudinal axis. The mass 134 is generally circular in cross-section. The mass 134 is made of a metal material such as brass, steel or tungsten. The properties of the base member 132 and the mass 134 are chosen such that the frequencies of the vibration absorbing device 110 are comparable to the same set of frequencies of the implement 12. The bending, torsional and longitudinal frequencies can be tuned by varying the length, width and thickness and material of the base member 132 and mass 134.

The mass 134 extends through the aperture 180 of the base member 132 such that the mass 134 is encapsulated. A cap 149 is placed over the end of the handle 20 to enclose the vibration absorbing device 110. The cap 149 is made of a plastic material. The mass 134 and base member 132 and their geometries are tuned such that the vibration absorbing device 110 vibrates at the same set of frequencies as the implement 12 but out of phase therewith. The mass 134 vibrates one hundred eighty degrees (180°) out of phase with the implement 12. The bending mode of the vibration absorbing device 110 occurs at the first bending mode of the implement 12. The torsional mode of the vibration absorbing device 110 occurs at the first torsional mode of the implement 12. The longitudinal mode of the vibration absorbing device 110 occurs at the first longitudinal mode of the implement 12. The base member 132 acts to absorb the energy at multiple frequencies generated by the mass 134 and to release the absorbed energy to the implement 12 to counteract energy produced in the implement 12 due to impact. The vibration absorbing device 110 reduces vibration of the implement as illustrated in FIG. 6. It should be appreciated that the corresponding modes of the vibration absorbing device 110 align with the corresponding modes of the implement 12.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A multi-mode vibration absorbing device for an implement comprising:

a viscoelastic base member to be mounted at least partially within a handle of the implement and having a body and a projection extending from said body with an aperture extending therethrough;

a mass extending through said aperture and directly supported by and cantilevered relative to said body, said device being tuned such that it vibrates at the same set of frequencies as the implement but out of phase therewith.

2. A multi-mode vibration absorbing device as set forth in claim 1 wherein said mass includes a shaft having a first head at one end and a second head at the other end.

3. A multi-mode vibration absorbing device as set forth in claim 2 wherein said first head is larger than said second head.

4. A multi-mode vibration absorbing device as set forth in claim 1 wherein said projection is offset relative to a centerline of said body.

5. A multi-mode vibration absorbing device as set forth in claim 1 wherein said body has first and second sides of unequal stiffness.

6. A multi-mode vibration absorbing device as set forth in claim 1 wherein said body has a recess for receiving a portion of the implement.

7. An implement comprising:

a frame including a head and a handle;

a vibration absorbing device mounted in said handle of said implement and including a viscoelastic base member having a body and a projection extending from said body with an aperture extending therethrough and a mass extending through said aperture and directly supported by and cantilevered relative to said body, said device being tuned such that it vibrates at the same frequency as said implement but out of phase therewith.

8. An implement as set forth in claim 7 wherein said multi-mode vibration absorbing device is disposed at the end of said handle opposite said head.

9. An implement as set forth in claim 7 wherein said mass includes a shaft having a first head at one end and a second head at the other end.

10. An implement as set forth in claim 9 wherein said first head is larger than said second head.

11. An implement as set forth in claim 9 wherein said projection is offset relative to a centerline of said body.

12. An implement as set forth in claim 9 wherein said body has first and second sides of unequal stiffness.

13. An implement as set forth in claim 9 wherein said mass is cylindrical in shape.

* * * * *